US012636534B2

(12) United States Patent
Chen et al.

(10) Patent No.: US 12,636,534 B2
(45) Date of Patent: May 26, 2026

(54) TRAMPOLINE WITH SMALL PACKAGE VOLUME

(71) Applicant: BESTWAY INFLATABLES & MATERIAL CORP., Shanghai (CN)

(72) Inventors: Xiaobo Chen, Jinhua City (CN); Fengwang Chen, Jinhua City (CN); Yanping Wu, Jinhua City (CN); Peng Pan, Jinhua City (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 93 days.

(21) Appl. No.: 18/534,976

(22) Filed: Dec. 11, 2023

(65) Prior Publication Data

US 2024/0198159 A1 Jun. 20, 2024

(30) Foreign Application Priority Data

Dec. 19, 2022 (CN) ..... 202223411346.X

(51) Int. Cl.
*A63B 5/11* (2006.01)
*A63B 71/02* (2006.01)

(52) U.S. Cl.
CPC ..... *A63B 5/11* (2013.01); *A63B 71/023* (2013.01)

(58) Field of Classification Search
CPC ..... A63B 5/11
See application file for complete search history.

(56) References Cited

U.S. PATENT DOCUMENTS

| | | | | |
|---|---|---|---|---|
| 2,743,834 | A * | 5/1956 | Williams | B65D 39/0023 215/354 |
| 4,339,123 | A * | 7/1982 | Rich | A63B 5/11 482/28 |
| 7,014,267 | B1 * | 3/2006 | Nagar | A47B 47/0008 297/440.14 |
| 10,786,697 | B2 * | 9/2020 | Liu | A63B 5/11 |
| 11,957,961 | B1 * | 4/2024 | Li | A63B 71/0054 |
| 2004/0071496 | A1 * | 4/2004 | Chun Yueh | A63B 5/11 403/14 |
| 2004/0147370 | A1 * | 7/2004 | Wang | G06F 3/03543 482/29 |
| 2007/0021272 | A1 | 1/2007 | Slade | |
| 2010/0240496 | A1 * | 9/2010 | Chen | A63B 5/11 482/27 |
| 2013/0210590 | A1 | 8/2013 | Publicover et al. | |
| 2017/0326399 | A1 * | 11/2017 | Woodman | A63B 71/023 |
| 2018/0036570 | A1 * | 2/2018 | Chen | A63B 71/022 |
| 2018/0093120 | A1 * | 4/2018 | Chen | A63B 5/11 |
| 2018/0256931 | A1 * | 9/2018 | Chen | F16F 1/26 |
| 2023/0043158 | A1 * | 2/2023 | Diao | A63B 71/022 |

OTHER PUBLICATIONS

Extended European Search Report dated Apr. 30, 2024 (Apr. 3, 20240, 7 pages, issued on related European patent application 23215343.7 by the European Patent Office.

* cited by examiner

*Primary Examiner* — William Boddie
(74) *Attorney, Agent, or Firm* — Dickinson Wright PLLC

(57) ABSTRACT

A trampoline is provided, the trampoline including a trampoline frame and leg pipes for supporting the trampoline frame. Each leg pipe includes a cross pipe and two stand pipes, the two stand pipes being detachably connected to two ends of the cross pipe to form a U-shaped structure. An upper end of each stand pipe is detachably connected to the trampoline frame.

3 Claims, 5 Drawing Sheets

TRAMPOLINE WITH SMALL PACKAGE VOLUME

CROSS-REFERENCE TO RELATED APPLICATION

This Application claims priority from Chinese Application CN202223411346.X, filed Dec. 19, 2022 in China, the disclosure of which is incorporated herein by reference in its entirety.

BACKGROUND

Field

Example embodiments relate to a trampoline, and more particularly to a trampoline with a small package volume.

Description of Related Art

At present, trampoline sports are becoming more and more popular. Many parks, playgrounds, gymnasiums, and other places are equipped with trampoline facilities, and even many families have purchased trampolines for leisure sports. In order to facilitate transportation, parts are usually transported to the site for trampoline installation. However, due to structural restrictions, many existing trampolines have a large package volume, and are inconvenient to assemble.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a trampoline comprises: a frame, and a plurality of leg pipes supporting the frame, wherein each of the plurality of leg pipes comprises: a cross pipe, a first stand pipe comprising a lower end detachably connected to a first end of the cross pipe and an upper end detachably connected to the frame, a second stand pipe comprising a lower end detachably connected to a second end of the cross pipe and an upper end detachably connected to the frame, and a first quick assembly joint and a second quick assembly joint, wherein the first quick assembly joint comprises two insertion columns respectively connected to the lower end of the first stand pipe and the first end of the cross pipe, and wherein the second quick assembly joint comprises two insertion columns respectively connected to the lower end of the second stand pipe and the second end of the cross pipe.

Each quick-assembly joint may comprise a support flat surface arranged on a surface opposite each of the two insertion columns.

An inner wall of each of the first end and the second end of the cross pipe may comprise a protrusion, and an outer wall of an insertion columns of each quick assembly joint may comprise a recess configured to engage with the protrusion.

An inner wall of the lower end of each stand pipe may comprise a protrusion, and an outer wall of an insertion column of each quick assembly joint may comprise a recess configured to engage with the protrusion.

A surface of the recess, facing away from the quick-assembly joint, may be inclined, thereby forming a positioning sidewall; and a surface of the protrusion on each of the first end and the second end of the cross pipe may be inclined, thereby forming a positioning side configured to abut against the positioning sidewall.

A surface of the recess, facing away from the quick-assembly joint, may be inclined, thereby forming a positioning sidewall; and a surface of the protrusion of each stand pipe may be inclined, thereby forming a positioning side configured to abut against the positioning sidewall.

The frame may comprise: an upper frame comprising a plurality of upper loop pipes connected end to end; a lower frame comprising a plurality of lower loop pipes connected end to end; and a plurality of support rods, each connected between the upper frame and a corresponding first or second stand pipe.

The frame may further comprise: a T-shaped joint connected between each two adjacent ones of the plurality of lower loop pipes, and connected to an upper end of a corresponding first stand pipe or second stand pipe.

The frame may further comprise: an end cover configured to be inserted into an end of each of the plurality of support rods and comprising an positioning slot; a connector connected between each two adjacent ones of the plurality of upper loop pipes, and configured to fit into the positioning slot of the end cover, the connector comprising: an insertion pipe disposed at each end of the connector and connected to a corresponding one of the plurality of upper loop pipes; wherein each of the plurality of support rods comprises an insertion slot configured to fit with the connector.

The frame may further comprise: a connector connected between each two adjacent ones of the plurality of upper loop pipes; a universal joint sleeved on the connector and comprising a connection socket; a universal ball connected to an upper end of each of the plurality of support rods, wherein the universal ball is movably inserted into the connection socket of the universal joint.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
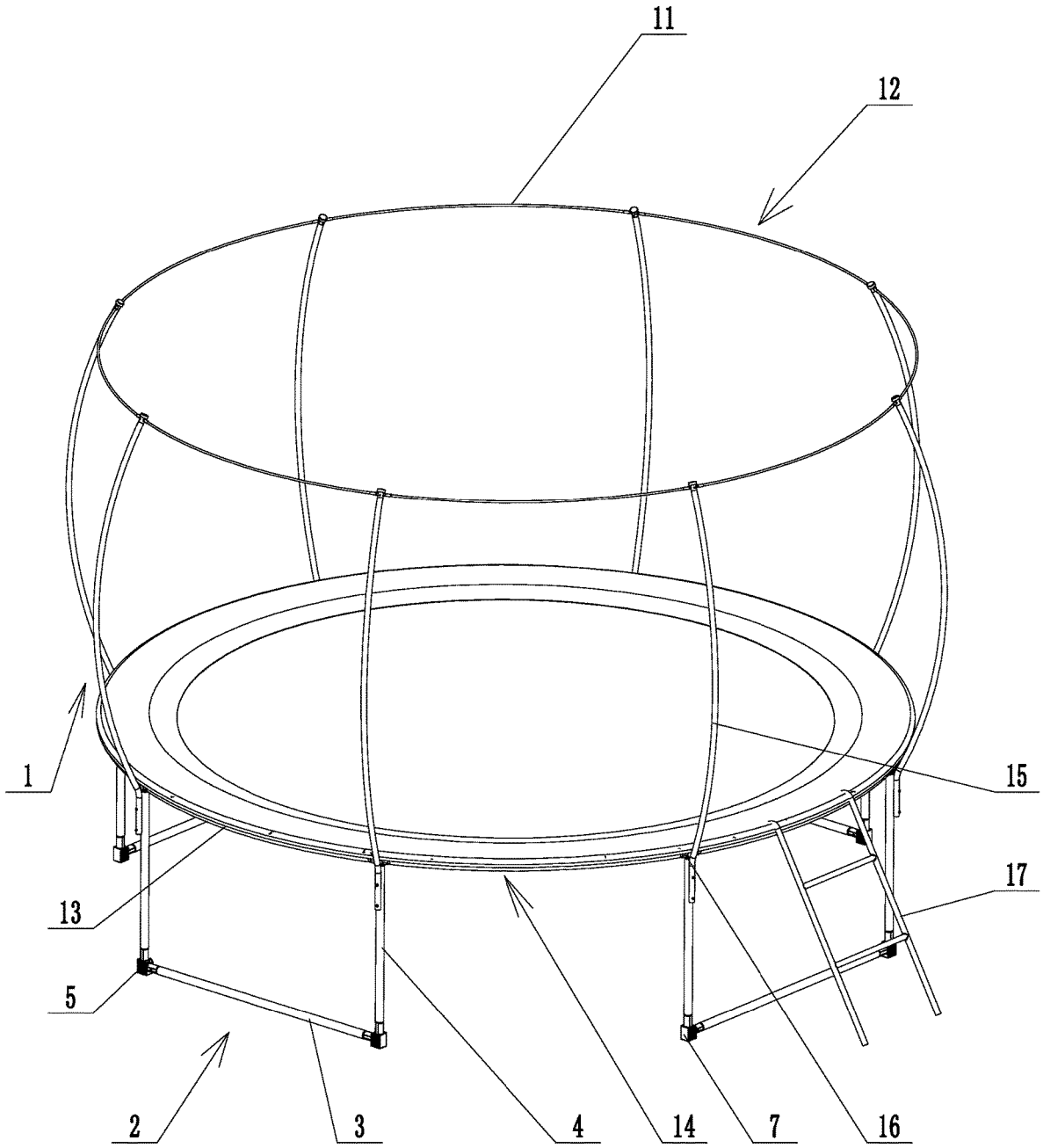
FIG. 1 is a schematic structural diagram of an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

Figure 2:
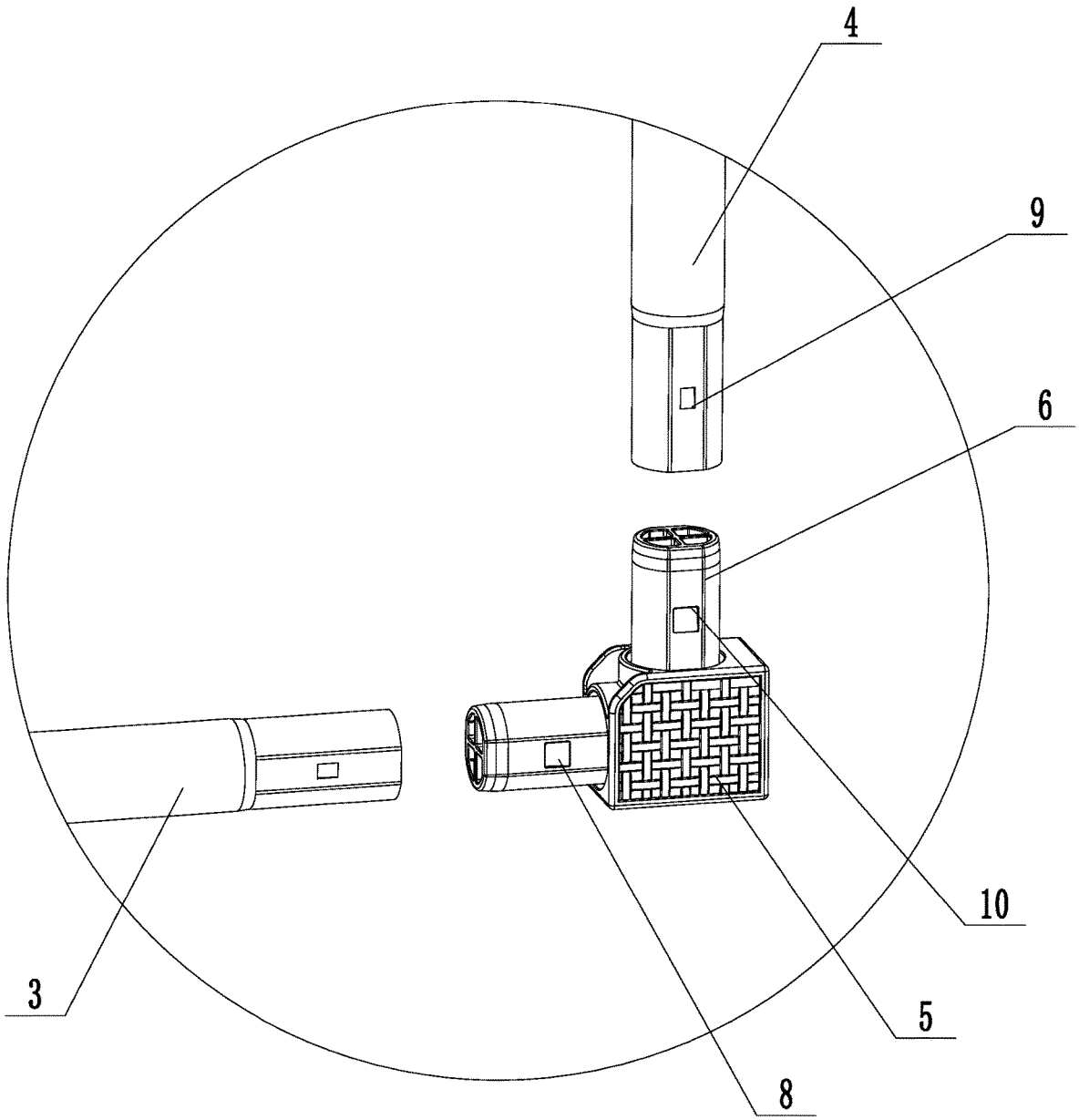
FIG. 2 is an exploded view showing a connection between a cross pipe and a stand pipe according to an example embodiment.
Figure 3:
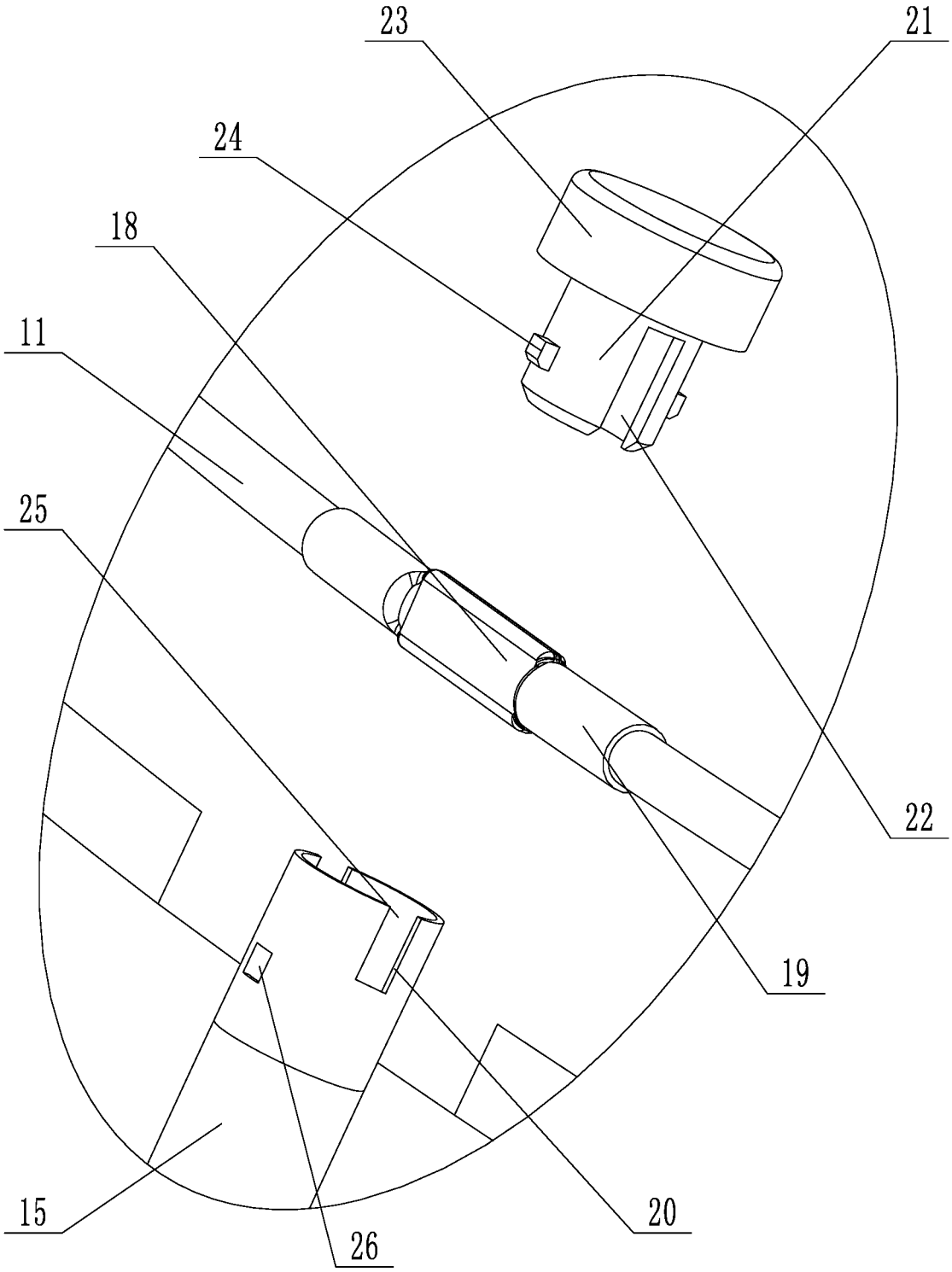
FIG. 3 is an exploded view showing a connection between a support rod and an upper frame according to a first example embodiment.

First example embodiment: A trampoline with a small package volume according to one or more example embodiments may (see FIGS. 1 to 3) comprise a trampoline frame 1 and leg pipes 2 which support the trampoline frame 1, wherein four leg pipes 2 may be evenly distributed in a circumferential direction around the frame 1. Each leg pipe 2 comprises a cross pipe 3 and two stand pipes 4; the two stand pipes 4 are detachably connected to respective ends of the cross pipe 3 to form a U-shaped structure; and an upper end of each stand pipe 4 is detachably connected to the trampoline frame 1. A quick-assembly joint 5 is connected between the cross pipe 3 and each of the two corresponding stand pipes 4, and the quick-assembly joint 5 may be plastic. Each quick-assembly joint 5 includes two insertion columns 6 each having an obround shape with an oval-shaped cross section. The cross pipe 3 and the stand pipe 4 may also have obround shapes with oval-shaped cross sections, and the two insertion columns 6 are inserted into the cross pipe 3 and the stand pipe 4, respectively, and are thereby connected. A support flat surface 7 is arranged on a surface of the quick-assembly joint 5 opposite each insertion column 6.

A protrusion 9 is provided on an inner wall of the cross pipe 3, and a corresponding recess 8 is provided in an outer wall of the insertion column 6, the protrusion 9 fitting into and engaging with the recess 8 when the insertion column 6 of the quick-assembly joint 5 is inserted into the cross pipe 3. A protrusion 9 is provided on an inner wall of the stand pipe 4, and a corresponding recess 8 is provided in an outer wall of the insertion column 6, the protrusion 9 fitting into and engaging with the recess 8 when the insertion column 6 of the quick-assembly joint 5 is inserted into the stand pipe 4. A bottom surface of the recess 8 (i.e. the surface configured to face the pipe into which it is to be inserted) is inclined, so as to allow the side of the recess 8 away from the quick-assembly joint 5 to form a positioning sidewall 10. A surface of the protrusion 9 is inclined and fits with the bottom surface of the recess 8, one side of the protrusion 9 forming a positioning side, and the positioning side abutting against the positioning sidewall 10.

The trampoline frame 1 may further comprise an upper frame 12 including a plurality of upper loop pipes 11 which are detachably connected end to end, a lower frame 14 including a plurality of lower loop pipes 13 which are detachably connected end to end, and a plurality of support rods 15, each connected between the upper frame 12 and a corresponding one of the stand pipes 4. That is to say, the upper loop pipes 11 are connected to each other to form the upper frame 12, and the lower loop pipes 13 are connected to each other to form the lower frame 14. Both the upper frame 12 and the lower frame 14 are substantially circular. A lower end of each support rod 15 is connected to a corresponding stand pipe 4 by means of screws. The support rod 15 has an arc-shaped structure which is convex and curved radially outward. A T-shaped joint 16 is connected between each two adjacent lower loop pipes 13 in an inserted manner, and the upper end of each stand pipe 4 is connected to a lower end of a corresponding T-shaped joint 16 in an inserted manner. A trampoline cloth is installed in the middle of the lower frame 14, and springs are connected between the trampoline cloth and the lower frame 14, such that a finished trampoline is formed. A ladder 17 is connected to the lower frame to facilitate climbing on and off the trampoline.

A connector 18 is connected between each two adjacent upper loop pipes 11 in an inserted manner, the connector 18 having a rectangular plate-shaped structure, and an insertion pipe 19 is provided at each end opposite of the connector 18 and is connected to a corresponding upper loop pipe 11 in an inserted manner. An insertion slot 20, fitting with the connector 18, is provided at an upper end of each support rod 15. An end cover 21 is connected to the upper end of each support rod 15 in an inserted manner, and is provided with a positioning slot 22 fitting with the connector 18. Both the insertion slot 20 and the positioning slot 22 are connected to the connector 18 in an inserted manner, and the connector 18 is arranged between the end cover 21 and the support rod 15. The end cover 21 includes a cap 23, and the cap 23 is thus supported at the upper end of the support rod 15. The end cover 21 includes an engagement protrusion 24, an installation hole 25 is provided at the upper end of the support rod 15, the end cover 21 is inserted into the installation hole 25, an engagement groove 26 is provided in a side wall of the installation hole 25, and the engagement protrusion 24 is engaged within the engagement groove 26.

A U-shaped leg pipe 2 is formed by two stand pipes 4 and one cross pipe 3 which are detachably connected with each other, and if it is required for storage and/or packaging, the cross pipe 3 and the stand pipes 4 may be detached from each other, such that the package volume can be reduced. During assembly, the two stand pipes 4 are connected to two ends of the cross pipe 3 to form a U-shaped structure, and the upper end of each stand pipe 4 is connected to the trampoline frame 1. The trampoline frame 1 is detachably attached, and if it is required for storage and/or packaging, the trampoline frame 1 may be disassembled, such that the package volume is small. If assembly is required, the trampoline frame 1 may be reconnected into an assembly which is stable and reliable.

Figure 4:
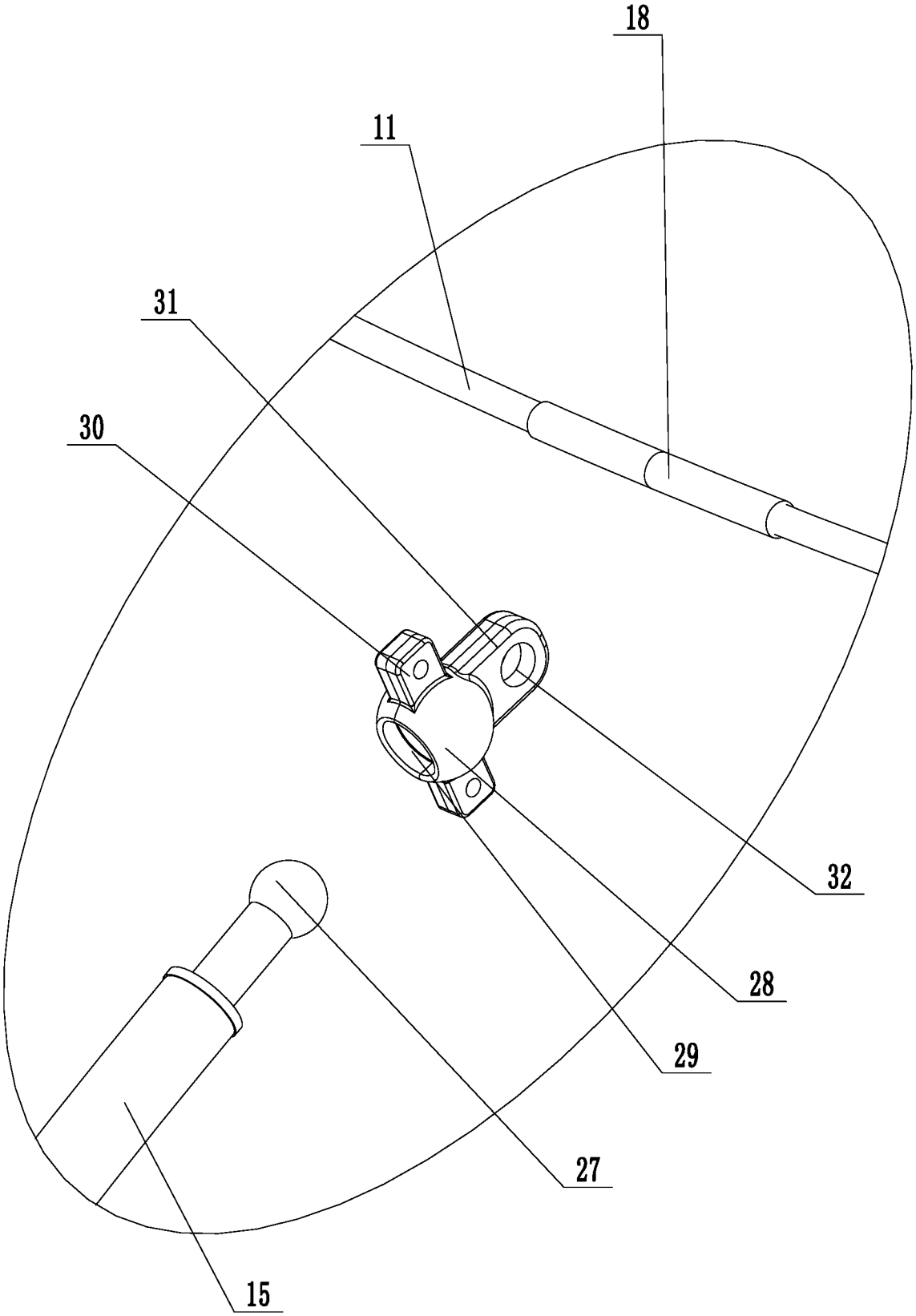
FIG. 4 is an exploded view showing a connection between a support rod and an upper frame according to a second example embodiment.

Second example embodiment: A trampoline with a small package volume (see FIG. 4), has a structure similar to that of the first example embodiment, and the main differences therebetween lie in that, in this example embodiment, a connector 18 is connected between each two adjacent upper loop pipes 11 in an inserted manner, the connector 18 having a tubular structure; and a universal ball 27 is connected to an upper end of a support rod 15. A universal joint 28 is sleeved on the connector 18, and is provided with a connection socket 29 fitting with the universal ball 27, and the universal ball 27 is movably inserted into the connection socket 29. The universal joint 28 comprises two connection bodies arranged opposite each other; a recess is provided in each connection body, and the recesses in the two connection bodies are arranged opposite each other to form the connection socket 29. Each connection body is provided with two connection lugs 30 and one holder 31; the holder 31 is provided with a connection hole 32; the connection lugs 30 on the two connection bodies are correspondingly and fixedly connected with each other; and the connection holes 32 on the two holders are connected to the connector 18 in an inserted manner. The universal ball 27 is movably inserted into the connection socket 29 and can rotate universally, which facilitates the installation of the support rod 15. The remaining structure is the same as that of the first example embodiment.

Figure 5:
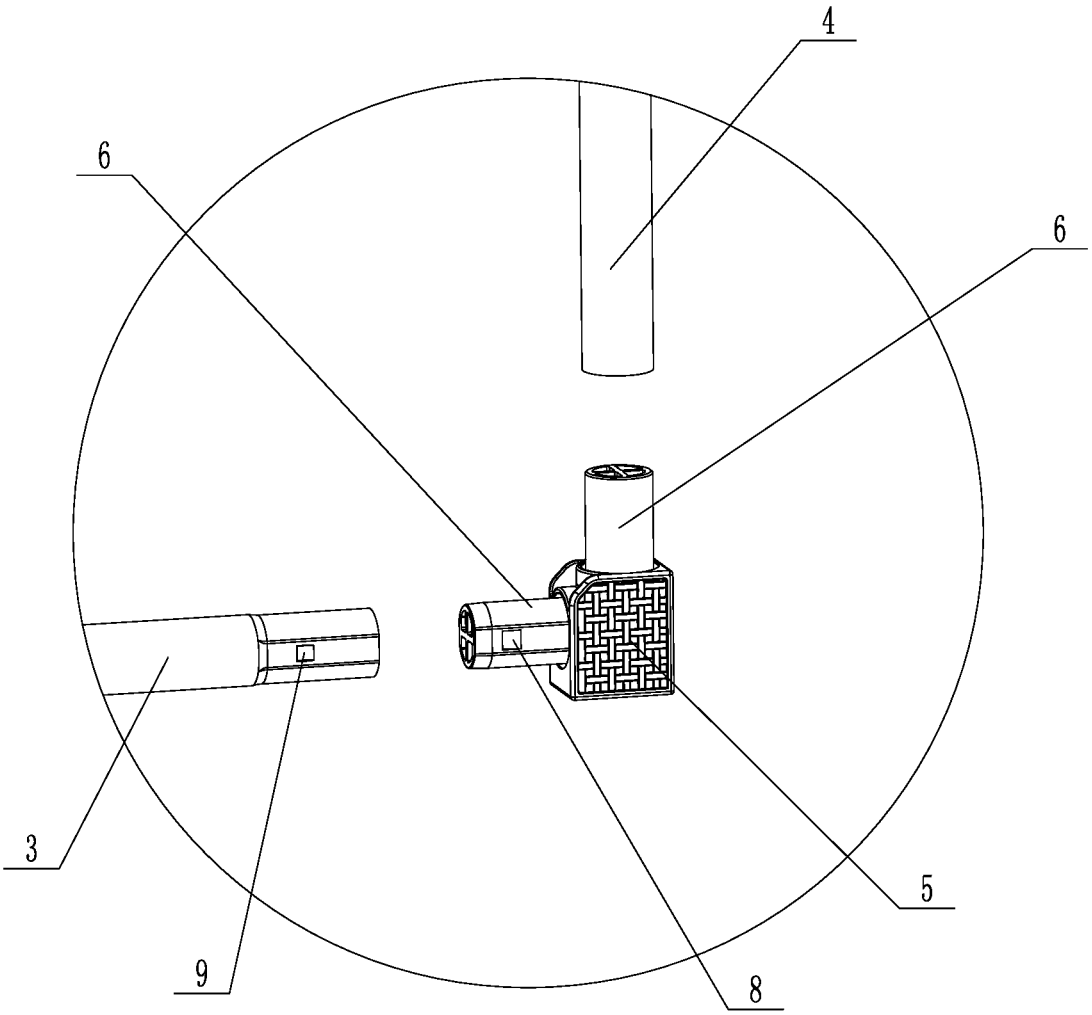
FIG. 5 is an exploded view showing a connection between a cross pipe and a stand pipe according to a third example embodiment.

This example embodiment: A trampoline with a small package volume (see FIG. 5) has a structure similar to those of the first example embodiment and the second example embodiment, and the main differences lie in that, in this example embodiment, a protrusion 9 is only provided on an inner wall of a cross pipe 3, and a recess 8 is provided in an outer wall of an insertion column 6 corresponding to the cross pipe 3, the protrusion 9 fitting and engaging with the recess 8. No protrusion is provided on a stand pipe 4, and no recess is provided in the insertion column 6 corresponding to the stand pipe 4. The cross pipe 3 and the corresponding insertion column 6 have an obround shape with an oval-shaped cross section, while the stand pipe 4 and the corresponding insertion column 6 have a circular cross section. The remaining structure is the same as that of the first example embodiment or the second example embodiment.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A trampoline comprising:
- a plurality of leg pipes; and
- a frame supported by the leg pipes and comprising:
  - an upper frame comprising:
    - a plurality of upper loop pipes connected end to end; and
    - a plurality of connectors, each of the plurality of connectors connected between each two adjacent ones of the plurality of upper loop pipes;
  - a lower frame comprising a plurality of lower loop pipes connected end to end; and
  - a plurality of support rods, each of the plurality of support rods including:
    - an upper end having a universal ball;
    - a lower end connected to one of the plurality of leg pipes; and
    - a plurality of universal joints, each of the plurality of universal joint sleeved on one of the plurality of connectors and comprising:
      - a connection socket;
      - two connection bodies arranged opposite each other, each of the two connection bodies including:
      - two connection lugs;
      - a holder; and
      - a connection hole provided on the holder, the connection hole on each of the two connection bodies being connected to the connector in an inserted manner; and
      - a recess provided in each connection body, each recess in the two connection bodies being arranged opposite each other to form the connection socket;
- wherein the universal ball is movable within the connection socket of the universal joint when inserted within the connection socket, the connection lugs on the two connection bodies are correspondingly and fixedly connected with each other.

2. The trampoline according to claim 1, wherein the frame further comprises:
- a T-shaped joint connected between each two adjacent ones of the plurality of lower loop pipes, and connected to an upper end of a corresponding one of the plurality of leg pipes.

3. The trampoline according to claim 1, wherein each connector is connected between each two adjacent upper loop pipes in an inserted manner, each connector having a tubular structure.

* * * * *